US008327910B2

(12) United States Patent
Walker et al.

(10) Patent No.: US 8,327,910 B2
(45) Date of Patent: Dec. 11, 2012

(54) METHOD OF SUPPORTING TUBING STRUCTURES DURING OVERCASTING

(75) Inventors: Michael J. Walker, Windsor (CA); Joshua D. Lasceski, Clinton Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 100 days.

(21) Appl. No.: 12/968,465

(22) Filed: Dec. 15, 2010

(65) Prior Publication Data

US 2012/0152481 A1 Jun. 21, 2012

(51) Int. Cl.
*B22D 19/00* (2006.01)
*B22D 19/02* (2006.01)

(52) U.S. Cl. ..... 164/98; 164/76.1

(58) Field of Classification Search ..... 164/76.1, 164/98

See application file for complete search history.

(56) References Cited

U.S. PATENT DOCUMENTS 4,344,477 A * 8/1982 Miki et al. ..... 164/98
4,832,106 A * 5/1989 Bucking et al. ..... 164/98

FOREIGN PATENT DOCUMENTS

| | | | |
|---|---|---|---|
| DE | 3013745 | A1 | 10/1981 |
| DE | 3129391 | C1 | 11/1982 |
| DE | 4102358 | A1 | 7/1992 |
| DE | 10335911 | A1 | 3/2005 |
| EP | 0638381 | A2 | 2/1995 |
| GB | 2073633 | A | 10/1981 |

* cited by examiner

*Primary Examiner* — Kevin P Kerns
(74) *Attorney, Agent, or Firm* — Quinn Law Group, PLLC

(57) ABSTRACT

A method of supporting a metal tube during an overcasting process includes radially supporting the metal tube from within an interior opening of the metal tube with a compressed granular material. The compressed granular material is held in place by a first stop and a second stop positioned at opposite axial ends of the metal tube. A tensile connector, such as a rod or a cable, interconnects and attaches the first stop and the second stop. Compressive radial forces exerted onto the metal tube during the overcasting process are transferred through the granular material and resisted by a tensile force in the tensile connector.

19 Claims, 3 Drawing Sheets

METHOD OF SUPPORTING TUBING STRUCTURES DURING OVERCASTING

TECHNICAL FIELD

The invention generally relates to a method of supporting a metal tube during an overcasting process.

BACKGROUND

In die-overcasting processes, wherein a cast metal, such as magnesium or aluminum is overcast onto a metal tube, such as a steel tube, an aluminum tube or a magnesium tube, the metal tube is prone to collapse under the intense pressures and/or temperatures exerted onto the metal tube. In order to prevent collapse of the metal tube during an overcasting process, the metal tube must be designed with sufficient cross sectional strength or otherwise be supported to resist collapse. The overcasting process may include any suitable process, including but not limited to a die casting process, a permanent mold process, a semi-permanent mold process or a sand casting process.

SUMMARY

A method of forming a bi-metallic composite structure is provided. The method includes positioning a first stop within an interior opening of a metal tube adjacent a first axial end of the metal tube, filling the interior opening of the metal tube with a granular material, and positioning a second stop within the interior opening of the metal tube adjacent a second axial end of the metal tube. The second stop is positioned such that the granular material is disposed between the first stop and the second stop. The method further includes compressing the granular material within the interior opening of the metal tube between the first stop and the second stop, and overcasting a cast metal onto the metal tube. The cast metal is overcast onto the metal tube while the granular material is under compression, with the granular material radially supporting the metal tube such that any compressive forces exerted during overcasting of the cast metal onto the metal tube are transferred through the metal tube and into the granular material to prevent collapse of the metal tube.

A method of supporting a metal tube for an overcasting process is also provided. The method includes positioning a first stop within an interior opening of the metal tube adjacent a first axial end of the metal tube, filling the interior opening of the metal tube with a granular material, and positioning a second stop within the interior opening of the metal tube. The second stop is positioned adjacent a second axial end of the metal tube such that the granular material is disposed between the first stop and the second stop. The method further includes compressing the granular material within the interior opening of the metal tube between the first stop and the second stop to radially support the metal tube, and securing the relative positions of the first stop and the second stop to a tensile connector interconnecting the first stop and the second stop.

Accordingly, the compressed granular material, which is held in place within the interior opening of the metal tube by the first stop and the second stop respectively, radially supports the metal tube during the overcasting process, thereby preventing the metal tube from collapsing. Any compressive forces exerted onto the metal tube during the overcasting process are transferred to the granular material, which presses against each of the first stop and the second stop thereby putting the tensile connection under tension. If the bi-metallic composite structure includes a tensile connector connecting the first stop and the second stop, then the tension within the tensile connector holds the first stop and the second stop in place, preventing the granular material from spreading axially within the interior opening of the metal tube, and thereby maintaining the radial support of the metal tube. Alternatively, if the first stop and the second stop are securely fixed to the metal tube, such as through mechanical pressure, a welded connection or a press fit engagement therebetween, then the metal tube may act as a tensile connector between the first stop and the second stop. Furthermore, if a die tool, such as but not limited to a "die pull" or other tooling, exerts a pressure onto the first stop and the second stop to compress the granular material, then the forces are reciprocated back into the die pull or other tooling. Once the overcasting process is complete, the first stop and the second stop may be disconnected from the tensile connector, and the granular material may simply be poured out of the interior opening of the metal tube and reclaimed for future use. Because the metal tube is radially supported by the granular material during the overcasting process, a wall thickness of the metal tube may be minimized to reduce the weight and cost of the bi-metallic structure.

The above features and advantages and other features and advantages of the present invention are readily apparent from the following detailed description of the best modes for carrying out the invention when taken in connection with the accompanying drawings.

DETAILED DESCRIPTION

Figure 1:
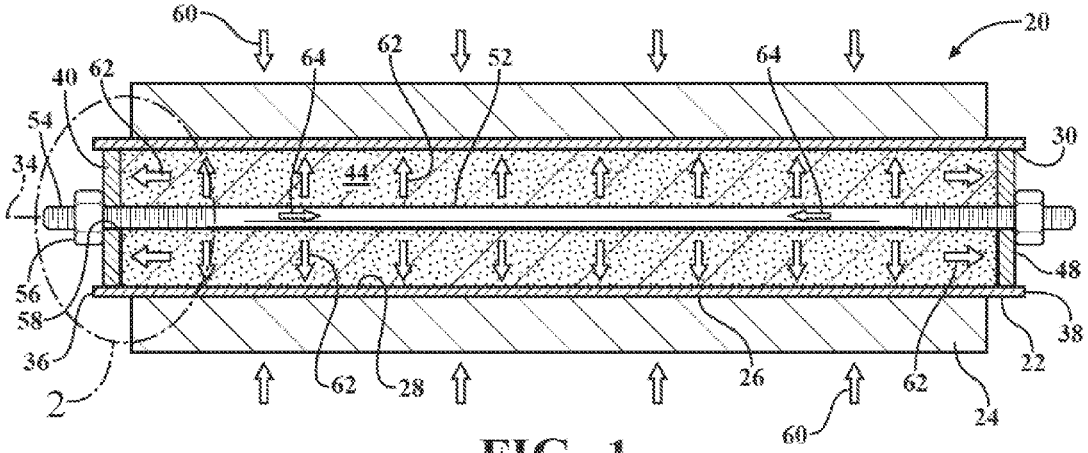
FIG. 1 is a schematic cross sectional view of a straight bi-layered metallic structure internally supported to resist compressive forces during an overcasting process by a granular material in accordance with the method disclosure herein.

Referring to the Figures, wherein like numerals indicate like parts throughout the several views, a bi-layered metallic structure is generally shown at 20. Referring to FIG. 1, the bi-layered metallic structure 20 includes a metal tube 22 with a layer of a cast metal 24 overcast onto the metal tube 22, thereby forming the bi-layered metallic structure 20. The metal tube 22 may include but is not limited to one of a steel tube, an aluminum tube or a magnesium tube. The cast metal 24 may include but is not limited to one of a cast magnesium metal or a cast aluminum metal.

Figure 3:
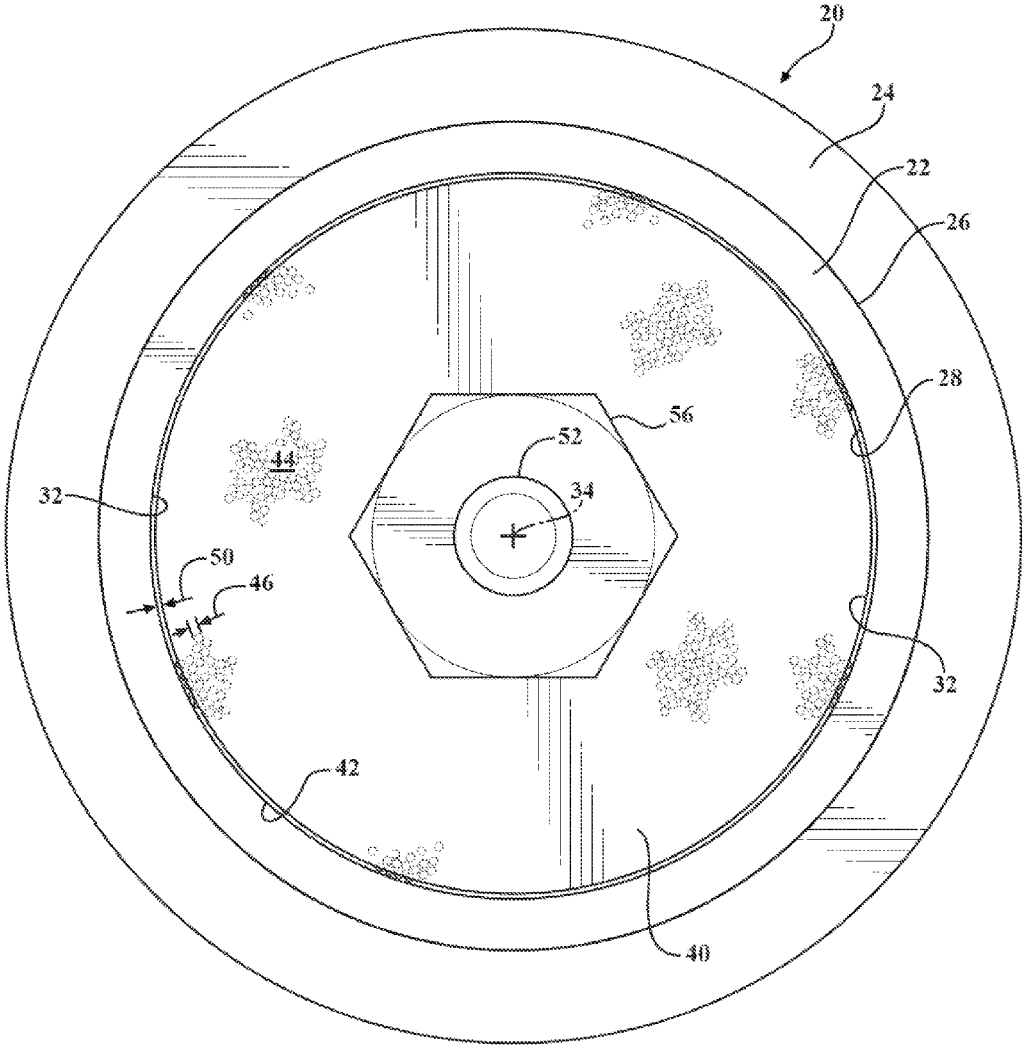
FIG. 3 is a schematic plan view of an end of the straight metal tube shown in FIG. 1.

Referring also to FIG. 3, the metal tube 22 includes a wall 26 having an interior surface 28 that defines an interior opening 30. The interior opening 30 defines an interior perimeter 32 that extends around a periphery of the interior surface 28. The metal tube 22, and the interior opening 30 defined thereby, extends along a longitudinal axis 34 that is centered along a centerline of the metal tube 22. The metal tube 22 includes a first axial end 36 and a second axial end 38 spaced from the first axial end 36 along the longitudinal axis 34. The metal tube 22 is open at both the first axial end 36 and the second axial end 38 to define a continuous passage extending through the metal tube 22. As shown, the metal tube 22 includes a circular cross sectional shape perpendicular to the longitudinal axis 34. However, it should be appreciated that the cross sectional shape of the metal tube 22 may include a different shape, including but not limited to a square shape, a rectangular shape, a polygon shape, an oval shape or a complex shape.

As noted above, the cast metal 24 is overcast over the metal tube 22 to form the bi-layered metallic structure 20. A method of forming the bi-layered metallic structure 20 includes positioning a first stop 40 within the interior opening 30 of the metal tube 22 adjacent the first axial end 36 of the metal tube 22. As shown in FIG. 3, the first stop 40 includes an outer perimeter 42 that is smaller than the interior perimeter 32 of the interior opening 30 such that the first stop 40 is freely moveable within the interior opening 30 of the metal tube 22. The first stop 40 may include but is not limited to a metal washer or some other similar device. Alternatively, the first stop 40 may include a tight fitting stopper press fit into the interior opening 30 of the metal tube 22 that completely closes and seals the first axial end 36 of the metal tube 22. The first stop 40 may also be permanently fixed to and close the metal tube 22, such as by welding.

The method further includes filling the interior opening 30 of the metal tube 22 with a granular material 44. The granular material 44 may include but is not limited to one of metal beads, metal shot, ceramic beads (proppant) or sand. The granular material may be hollow, such as but not limited to glass spheres, or may be solid. The granular material 44 is preferably a non-compressible material. As used herein, the non-compressible material is defined to include a material capable of withstanding compressive stresses without significant deforming or fracturing. The granular material 44 may include but is not limited to a uniform gradation. It should be appreciated that the granular material 44 includes a plurality of granules, each having an effective diameter 46, and that the uniform gradation of the granular material 44 may be interpreted to include each of the granules having a slightly different effective diameter 46 that falls within a pre-defined range and/or size. Alternatively, if the granular material 44 does not include a uniform gradation, then the size of the individual granules are limited to a minimum size that is incapable of escaping from within the metal tube 22, around the first stop 40 and/or the second stop 48. The various sizes of the granules of the granular material 44 may be selected to maximize packing density, thereby maximizing the compressive strength of the conglomerate of the granular material 44. While the effective diameter 46 of the granules of the granular material 44 is described as including a diameter, it should be appreciated that the effective diameter 46 may include other non-circular shapes, and that the effective diameter 46 may include a minimum distance between any two opposing surfaces.

Once the interior opening 30 of the metal tube 22 is filled with the granular material 44, then a second stop 48 is positioned within the interior opening 30 of the metal tube 22 adjacent the second axial end 38 of the metal tube 22. The second stop 48 is positioned such that the granular material 44 is disposed between the first stop 40 and the second stop 48. As with the first stop 40 and similar to the representation of FIG. 3, the second stop 48 includes an outer perimeter 42 that is smaller than the interior perimeter 32 of the interior opening 30 such that the second stop 48 is freely moveable within the interior opening 30 of the metal tube 22. The second stop 48 may include but is not limited to a metal washer or some other similar device. Alternatively, the second stop 48 may include a "die-pull" device located within a die or mold than is capable of sealing the interior opening 30 of the metal tube 22 and applying a compressive force to the granular material 44.

The outer perimeter 42 of the first stop 40 and the interior perimeter 32 of the interior opening 30 define a radial difference 50, i.e., a gap, therebetween. Similarly, the outer perimeter 42 of the second stop 48 and the interior perimeter 32 of the interior opening 30 also define a radial difference 50, i.e., a gap therebetween. The radial difference 50 between the interior perimeter 32 of the interior opening 30 and the outer perimeter 42 of the first stop 40 and the second stop 48 respectively is greater than the minimum effective diameter 46 of the granular material 44, thereby ensuring that the granular material 44 may not slip between the wall 26 of the metal tube 22 and the first stop 40 and/or the second stop 48 respectively so that the mass of the granular material 44 within the interior opening 30 of the metal tube 22 remains constant. The radial difference 50 may be very minimal or non-existent. A minimal friction fit between the first stop 40 and/or the second stop 48 and the metal tube 22 is possible, with the outer perimeter 42 of the first stop 40 and/or the second stop 48 being slightly larger than the interior perimeter 32 of the metal tube 22. However, a friction fit between the first stop 40 and/or the second stop 48 and the metal tube 22 would increase the required compressive force to compress the granular material 44 and increase the difficulty in removing the first stop 40 and/or the second stop 48. Such a friction fit would require a mechanical force to remove the first stop 40 and/or the second stop 48.

The method further includes compressing the granular material 44 within the interior opening 30 of the metal tube 22, between the first stop 40 and the second stop 48. The compression need only be enough to resist and prevent the metal tube 22 from collapsing during the overcasting process. As such, the granular material 44 may only need to be minimally compressed. The amount of compression may depend upon the type and size of the granular material 44, as well as the force that the metal tube 22 will be exposed to during the overcasting process. The granular material 44 may be compressed in any suitable manner. For example, the granular material 44 may be compressed by attaching the first stop 40 to the second stop 48 together with a tensile connector 52, drawing the first stop 40 and the second stop 48 together to compress the granular material 44, and then securing the first stop 40 and the second stop 48 to the tensile connector 52 to maintain the positions of the first stop 40 and the second stop 48 relative to the tensile connector 52. Alternatively, the granular material 44 may be compressed, for example, by applying and maintaining an axial pressure against the first stop 40 and the second stop 48 respectively, such as with a die tool, including but not limited to a die pull, a press or the like, in which case a minimal friction fit between the first stop 40 and/or the second stop 48 and the metal tube 22 may be desirable.

Figure 4:
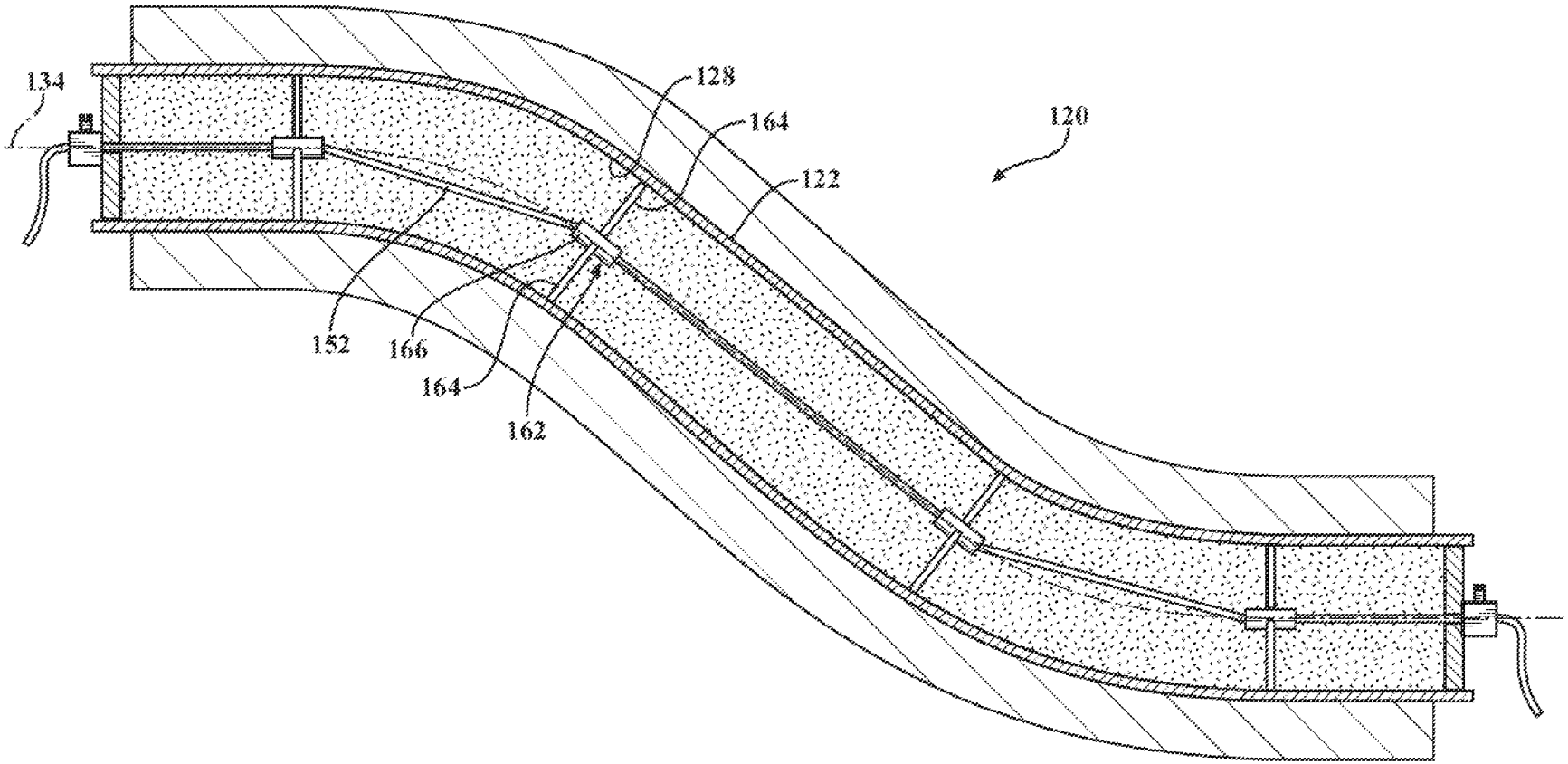
FIG. 4 is a schematic cross sectional view of a curved bi-layered metallic structure internally supported to resist compressive forces during an overcasting process by a granular material in accordance with the method disclosure herein.

As shown in FIG. 1, the first stop 40 and the second stop 48 are connected and attached together with the tensile connector 52. However, it should be appreciated that the first stop 40 and the second stop 48 need not be connected together by the tensile connector 52, and the first stop 40 and the second stop 48 may be secured in place in some other manner. The tensile connector 52 may include but is not limited to one of a rod or a cable. As shown in FIG. 1, the tensile connector 52 includes a threaded rod. As shown in FIG. 4, the tensile connector 52 includes a flexible cable. The tensile connector 52 may be manufactured from but is not limited to a metal. The tensile connector 52 includes a tensile strength that is dependent upon the material and cross sectional size of the material used for the tensile connector 52. The tensile connector 52 may be positioned along an approximate centerline of the interior opening 30 of the metal tube 22. However, it should be appreciated that the tensile connector 52 may be offset from the approximate centerline of the metal tube 22. Additionally, the tensile connector 52 may include multiple connectors positioned throughout the interior opening 30 of the metal tube 22.

Figure 2:
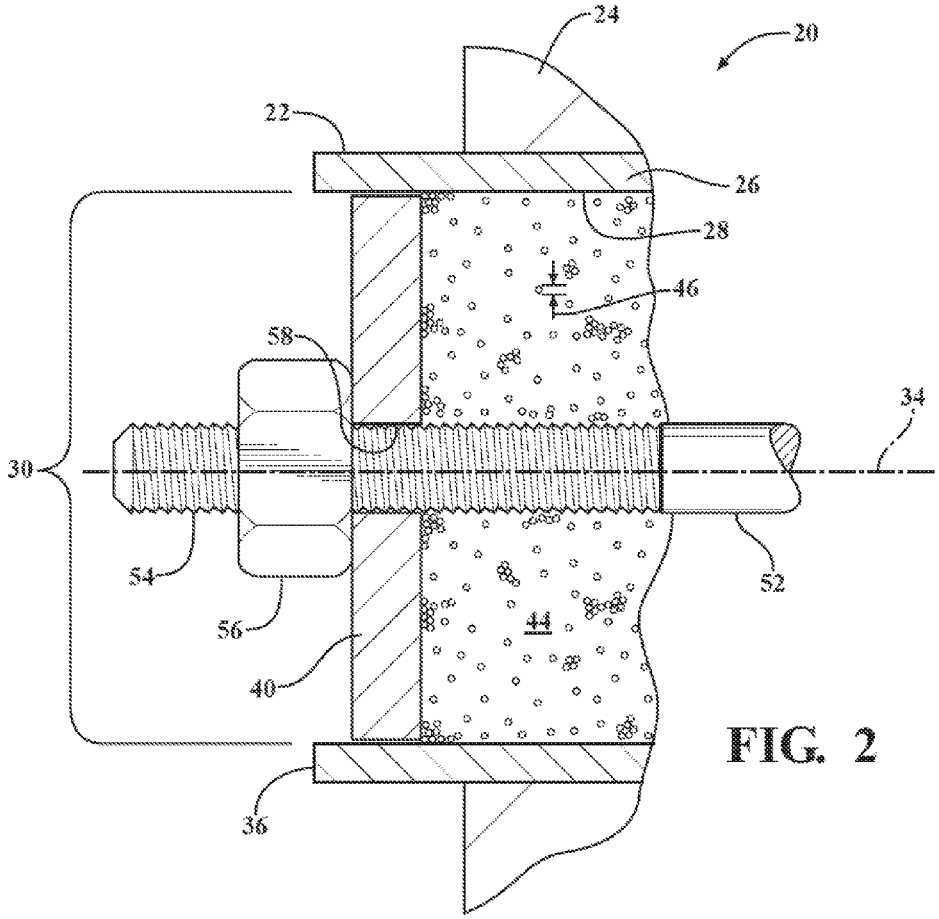
FIG. 2 is an enlarged schematic view of an end of the straight metal tube shown in FIG. 1.

Referring to FIG. 2, at least one of the first stop 40 and the second stop 48 includes a threaded connection securing the first stop 40 and/or the second stop 48 to the tensile connector 52. The method further includes tightening the threaded connection to draw the first stop 40 and the second stop 48 together to compress the granular material 44. As best shown in FIG. 2, the tensile connector 52 includes a threaded end 54 in threaded engagement with a nut 56. The nut 56 is disposed on an outer surface of the first stop 40 and/or the second stop 48, opposite the granular material 44. The first stop 40 and/or the second stop 48 define an aperture 58, shown in FIG. 1, through which the threaded end 54 of the tensile connector 52 extends through. Tightening the nut 56 on the threaded end 54 of the tensile connector 52 draws the first stop 40 and/or the second stop 48 together, thereby compressing the granular material 44 therebetween.

Alternatively, the first stop 40 and the second stop 48 may be secured to the tensile connector 52 in some other manner, such as but not limited to a clamp or some other similar device. Accordingly, the method may include securing the first stop 40 and the second stop 48 to the tensile connector 52 after compressing the granular material 44 to maintain compression of the granular material 44. As such, compressing the granular material 44 may include drawing the first stop 40 and the second stop 48 together prior to securing the first stop 40 and the second stop 48 to the tensile connector 52. The granular material 44 may be compressed and the first stop 40 and the second stop 48 drawn together by some other mechanical method, such as but not limited to a press or the like, after which the first stop 40 and the second stop 48 are mechanically attached to the tensile connector 52.

The method further includes overcasting the cast metal 24 onto the metal tube 22. The cast metal 24 is overcast onto the metal tube 22 while the granular material 44 is under compression so that the granular material 44 may radially support the metal tube 22. The granular material 44 radially supports the metal tube 22 so that any compressive forces, generally indicated by force arrows 60, exerted onto the metal tube 22 during overcasting of the cast metal 24 onto the metal tube 22 are transferred through the metal tube 22 and into the granular material 44. The granular material 44 provides a resistive force, generally indicated by force arrows 62, thereby preventing collapse of the metal tube 22. The overcasting may be accomplished by any suitable overcasting process including but not limited to a die casting process, a permanent mold process, a semi-permanent mold process or a sand casting process. The overcasting process may include the application of heat and/or pressure onto the cast metal 24 to form the cast metal 24 to the outer perimeter 42 of the metal tube 22. Any compressive forces that are transferred to the granular material 44 during the overcasting process are transferred to the tensile connector 52, generally indicated by force arrows 64. The tensile strength of the tensile conductor is designed to be greater than a projected tensile force created by any compressive forces exerted during overcasting of the cast metal 24 onto the metal tube 22. Because the tensile strength of the tensile connector 52 is greater than the tensile forces created by the compressive forces, the tensile connector 52 does not yield under the compressive forces exerted during overcasting of the cast metal 24 onto the metal tube 22. It should be appreciated that the compressive forces applied to the granular material 44 during the overcasting process are thereby applied against the first stop 40 and the second stop 48 and urge the first stop 40 and the second stop 48 outward away from each other. This compressive force that is applied to the first stop 40 and the second stop 48 is resisted by the tensile force in the tensile connector 52, thereby preventing any relative axial movement between the first stop 40 and the second stop 48, which maintains the volume, shape and size of the granular material 44 within the interior opening 30 of the metal tube 22, which prevents the metal tube 22 from collapsing.

The method further includes disconnecting the tensile connector 52 from at least one of the first stop 40 and the second stop 48 after the cast metal 24 is overcast onto the metal tube 22. Once at least one of the first stop 40 and the second stop 48 are disconnected from the tensile connector 52, the method further includes removing the first stop 40, the tensile connector 52, the granular material 44 and the second stop 48 from within the interior opening 30 of the metal tube 22 after overcasting the cast metal 24 onto the metal tube 22. The granular material 44 may be removed from the interior opening 30 of the metal tube 22 by pouring the granular material 44 out of the interior opening 30. The granular material 44 may be poured into a container such that the granular material 44 is reclaimed, and capable of being re-used in the future.

Referring to FIG. 4, an alternative embodiment of the bimetallic structure is generally shown at 120. The structure 120 includes a metal tube 122 extending along a longitudinal axis 134. The metal tube 122 and the longitudinal axis 134 extend along a curvilinear path. In order to position a tensile connector 152 substantially along the centerline of the metal tube 122, the tensile connector 152 may include at least one support 162 attached thereto. The supports 162 are spaced from each of the first stop 40 and the second stop 48 along the length of the tensile connector 152. The supports 162 are arranged such that the supports 162 space the tensile connector 152 from the interior surface 128 of the metal tube 122, and position the tensile connector 152 along the approximate centerline of the interior opening. The supports 162 may be configured in any suitable manner capable of attachment to the tensile connector 152 and spacing the tensile connector 152 from the interior surface 128 of the metal tube 122. For example, as shown in FIG. 4, the supports 162 are shown with a plurality of fingers 164 extending radially outward from a central tube 166. The tensile connector 152 passes through a center of the tube, and each of the fingers 164 reach out and engage an interior surface 128 of the metal tube 122. The fingers 164 are stiff enough to maintain the position of the tensile connector 152, yet flexible enough so that the supports 162 may be drawn through the interior opening of the metal tube 122 without binding. It should be appreciated that the supports 162 may be configured in some other manner not shown or described herein.

Other embodiments of the above described invention are also contemplated. For example, both the first stop 40 and the second stop 48 may be permanently fixed to the metal tube 22 to define closed ends, with one of the first stop 40 and the second stop 48 defining a threaded bore. The granular material 44 may be poured into the interior opening 30 and poured out of the interior opening 30 through the threaded bore, with the threaded bore allowing for a bolt to compress the granular material 44. Alternatively, the interior surface 28 of the metal tube 22 may include and define threads for receiving one of the first stop 40 and the second stop 48 in threaded engagement, thereby allowing for removal and attachment of the first stop 40 and/or the second stop 48 to the metal tube 22, and compression of the granular material 44.

While the best modes for carrying out the invention have been described in detail, those familiar with the art to which this invention relates will recognize various alternative designs and embodiments for practicing the invention within the scope of the appended claims.

The invention claimed is:

1. A method of forming a bi-layered metallic structure, the method comprising:

positioning a first stop within an interior opening of a metal tube adjacent a first axial end of the metal tube;

filling the interior opening of the metal tube with a granular material;

positioning a second stop within the interior opening of the metal tube adjacent a second axial end of the metal tube such that the granular material is disposed between the first stop and the second stop;

attaching the first stop to the second stop together with a tensile connector;

compressing the granular material within the interior opening of the metal tube between the first stop and the second stop; and overcasting a cast metal onto the metal tube while the granular material is under compression to radially support the metal tube such that any compressive forces exerted during overcasting the cast metal onto the metal tube are transferred through the metal tube and into the granular material to prevent collapse of the metal tube.

2. A method as set forth in claim 1 wherein the tensile connector includes a tensile strength, and wherein any compressive forces transferred to the granular material is transferred to the tensile connector, with the tensile strength of the tensile connector being greater than a tensile force created by any compressive forces exerted during overcasting of the cast metal onto the metal tube such that the tensile connector does not yield under any compressive forces exerted during overcasting the cast metal onto the metal tube.

3. A method as set forth in claim 1 wherein the tensile connector includes one of a rod or a cable.

4. A method as set forth in claim 1 further comprising positioning the tensile connector along an approximate centerline of the interior opening of the metal tube.

5. A method as set forth in claim 4 wherein the tensile connector includes at least one support attached thereto and spaced from each of the first stop and the second stop, wherein the at least one support spaces the tensile connector from an interior surface of the metal tube to position the tensile connector along the approximate centerline of the interior opening.

6. A method as set forth in claim 1 wherein the interior opening defines an interior perimeter and the first stop and the second stop each include an outer perimeter that is smaller than the interior perimeter of the interior opening such that the first stop and the second stop are freely moveable within the interior opening of the metal tube.

7. A method as set forth in claim 6 wherein the granular material includes a minimum effective diameter for each granule of the granular material, and wherein a radial difference between the interior perimeter of the interior opening and the outer perimeter of the first stop and the second stop respectively is greater than the minimum effective diameter of the granular material.

8. A method as set forth in claim 1 wherein attaching the first stop to the second stop together with a tensile connector includes securing the first stop and the second stop to the tensile connector after compressing the granular material to maintain compression of the granular material.

9. A method as set forth in claim 8 wherein compressing the granular material includes drawing the first stop and the second stop together prior to securing the first stop and the second stop to the tensile connector.

10. A method as set forth in claim 1 wherein at least one of the first stop and the second stop includes a threaded connection securing one of the first stop or the second stop to the tensile connector, wherein the method further includes tightening the threaded connection to draw the first stop and the second stop together to compress the granular material.

11. A method as set forth in claim 1 wherein compressing the granular material is further defined as compressing the granular material by applying a compressive force with a die tool.

12. A method as set forth in claim 1 further comprising disconnecting the tensile connector from at least one of the first stop and the second stop after the cast metal is overcast onto the metal tube.

13. A method as set forth in claim 12 further comprising removing the first stop, the tensile connector, the granular material and the second stop from within the interior opening of the metal tube after overcasting the cast metal onto the metal tube.

14. A method as set forth in claim 13 wherein removing the granular material from the interior opening of the metal tube includes pouring the granular material out of the interior opening such that the granular material is reclaimed for future use.

15. A method as set forth in claim 1 wherein the metal tube includes one of a steel tube, an aluminum tube or a magnesium tube, and wherein the cast metal includes one of a cast magnesium metal or a cast aluminum metal.

16. A method as set forth in claim 1 wherein the granular material includes one of metal beads, metal shot, ceramic beads or sand.

17. A method of supporting a metal tube for an overcasting process, the method comprising:

positioning a first stop within an interior opening of the metal tube adjacent a first axial end of the metal tube;

filling the interior opening of the metal tube with a granular material;

positioning a second stop within the interior opening of the metal tube adjacent a second axial end of the metal tube such that the granular material is disposed between the first stop and the second stop;

compressing the granular material within the interior opening of the metal tube between the first stop and the second stop to radially support the metal tube; and securing the relative positions of the first stop and the second stop with a tensile connector that interconnects the first stop and the second stop.

18. A method as set forth in claim 17 wherein the tensile connector includes at least one support attached thereto and spaced from each of the first stop and the second stop, and wherein the method further includes positioning the at least one support within the interior opening of the metal tube to space the tensile connector from an interior surface of the metal tube and position the tensile connector along an approximate centerline of the interior opening.

19. A method as set forth in claim 17 wherein securing the relative positions of the first stop and the second stop to a tensile connector interconnecting the first stop and the second stop is further defined as securing the first stop and the second stop to the tensile connector after compressing the granular material to maintain compression of the granular material.

* * * * *